US005310120A

United States Patent [19]

Ehinger et al.

[11] Patent Number: 5,310,120

[45] Date of Patent: May 10, 1994

[54] SPRAYING DEVICE WITH AN INSULATED STORAGE TANK FOR ELECTRICALLY CONDUCTIVE COATING PRODUCT

[75] Inventors: Pierre Ehinger, Faverges; Djamel Merabet, Grenoble, both of France

[73] Assignee: Sames S.A., Meylan, France

[21] Appl. No.: 101,019

[22] Filed: Aug. 3, 1993

[30] Foreign Application Priority Data

Sep. 9, 1992 [FR] France ..... 92 10746

[51] Int. Cl.[5] ..... B05B 5/16

[52] U.S. Cl. ..... 239/708; 239/690; 239/322; 118/629; 222/389

[58] Field of Search ..... 239/690, 708, 320, 321, 239/322; 118/621, 626, 629; 222/389

[56] References Cited

U.S. PATENT DOCUMENTS

| | | | |
|---|---|---|---|
| 4,771,729 | 9/1988 | Planert et al. | 118/629 X |
| 4,779,804 | 10/1988 | Baba et al. | 239/690 |
| 4,785,760 | 11/1988 | Tholome . | |
| 4,798,341 | 1/1989 | Gimple | 239/708 X |
| 4,879,137 | 11/1989 | Behr et al. | 118/626 X |
| 4,921,169 | 5/1990 | Tilly | 239/690 X |
| 5,083,711 | 1/1992 | Giroux et al. | 239/690 |
| 5,199,650 | 4/1993 | Ishibashi et al. | 239/690 X |
| 5,249,748 | 10/1993 | Lacchia et al. | 239/690 |
| 5,255,856 | 10/1993 | Ishibashi et al. | 239/690 X |

FOREIGN PATENT DOCUMENTS

| | | |
|---|---|---|
| 2635990 | 3/1990 | France . |
| 2668956 | 5/1992 | France . |
| 2249498 | 5/1992 | United Kingdom . |
| 2249976 | 5/1992 | United Kingdom . |

*Primary Examiner*—Andres Kashnikow
*Assistant Examiner*—William Grant
*Attorney, Agent, or Firm*—Spensley Horn Jubas & Lubitz

[57] ABSTRACT

An electrostatic device for spraying electrically conductive liquid coating product comprises a storage tank for the product in which the product is at a high voltage. The tank is defined in a substantially cylindrical cavity formed in an insulative material body and inside in which is a piston forming in the cavity a mobile wall separating a coating product chamber from an actuation chamber filled with an electrically insulative actuation fluid. The body is fixed to a conductive material socket which is grounded and to which is connected an actuation fluid supply circuit extending between the socket and the actuation chamber and discharging into the actuation chamber near a back wall of the cavity which is not in contact with the coating product. A section of the supply circuit runs substantially parallel to the cavity in the direction away from the socket starting from the back wall.

12 Claims, 2 Drawing Sheets

SPRAYING DEVICE WITH AN INSULATED STORAGE TANK FOR ELECTRICALLY CONDUCTIVE COATING PRODUCT

BACKGROUND OF THE INVENTION

1. Field of the Invention

The invention concerns an electrostatic device for spraying an electrically conductive liquid coating product such as a water-based paint. It is more particularly concerned with a compact and lightweight unit including a storage tank for a product of this kind which is usually at a high voltage during spraying, the unit being adapted to prevent the establishment of any tracking current between a part at the high voltage and any other part which is designed to be at a different potential, typically ground potential.

The invention is more particularly, but not exclusively, concerned with a unit incorporating an intermediate storage tank of this kind and at least one electrostatic sprayer which is sufficiently compact and light in weight to be carried by a multi-axis robot whose various articulated segments are grounded.

2. Description of the Prior Art

The patent U.S. Pat. No. 4 785 760 describes an electrostatic system for spraying a conductive coating product which is noteworthy in that the quantity of product required to paint an object is stored in a storage tank carried by a multi-axis robot. The latter carries the electrostatic sprayer in the immediate vicinity of the storage tank. It may advantageously also carry at least the high-voltage part of the electrical power supply. The high-voltage output of the power supply is connected to the sprayer with the result that all of the conductive coating product in the storage tank is at the high voltage. A system of this kind has two major advantages. It eliminates long hoses between the coating product distribution circuit and the sprayer carried by the robot, which saves significant quantities of coating product each time the product is changed, i.e. each time the color is changed, and it makes it a simple matter to provide the necessary galvanic insulation between the storage tank and the supply circuit (which is grounded) during spraying when the coating product is a conductive product applied electrostatically.

The invention concerns a compact and lightweight insulated intermediate storage tank of this kind adapted to contain a conductive coating product at a high voltage.

The device of the invention is noteworthy by virtue of the set of arrangements adopted to prevent the formation of leakage currents resulting from so-called "tracking" phenomena along surfaces which are in theory insulated between a member at the high voltage and any member at a different potential, in particular ground potential.

SUMMARY OF THE INVENTION

The invention consists in an electrostatic device for spraying electrically conductive liquid coating product comprising a storage tank for said product in which said product is at a high voltage defined in a substantially cylindrical cavity formed in an insulative material body and inside which is a piston forming in said cavity a mobile wall separating a coating product chamber from an actuation chamber filled with an electrically insulative actuation fluid, said body being fixed to a conductive material socket which is grounded and to which is connected an actuation fluid supply circuit extending between said socket and said actuation chamber and discharging into said actuation chamber near a back wall of said cavity which is not in contact with said coating product, a section of said supply circuit running substantially parallel to said cavity in the direction away from said socket starting from said back wall.

All of the cavity (as f ar as the back wall of the actuation chamber) may be assumed to be at the high voltage at least when the piston is pushed back into contact with the back wall, i.e. when the storage tank is filled with coating product. Said actuation fluid supply circuit necessarily discharges into the actuation chamber and could therefore be a likely place for any tracking current to appear. If grounded metal members are present near this circuit, for example if a grounded mounting socket is used, but also if any screened component is installed nearby, the invention makes it possible to guarantee a "path" of sufficient length along insulative surfaces of the actuation fluid supply circuit from the actuation chamber to prevent the occurrence of tracking currents. One example of a screened component is a resistive sensor (of the potentiometer type) adapted to determine the position of the piston and to track its movements in order to control the flowrate of the coating product so that the quantity of product in the storage is known at all times. The length of the "path" as defined above obviously depends on the value of the high voltage. According to another advantageous feature of the invention the back wall and at least the greater part of the cylindrical wall of the cavity are parts of a common unit of said body.

The invention will be better understood and other advantages of the invention will emerge more clearly from the following description of an electrostatic device in accordance with the invention for spraying an electrically conductive liquid coating product. This description is given by way of example only with reference to the appended drawings.

DETAILED DESCRIPTION OF THE INVENTION

Figures 1, 2:
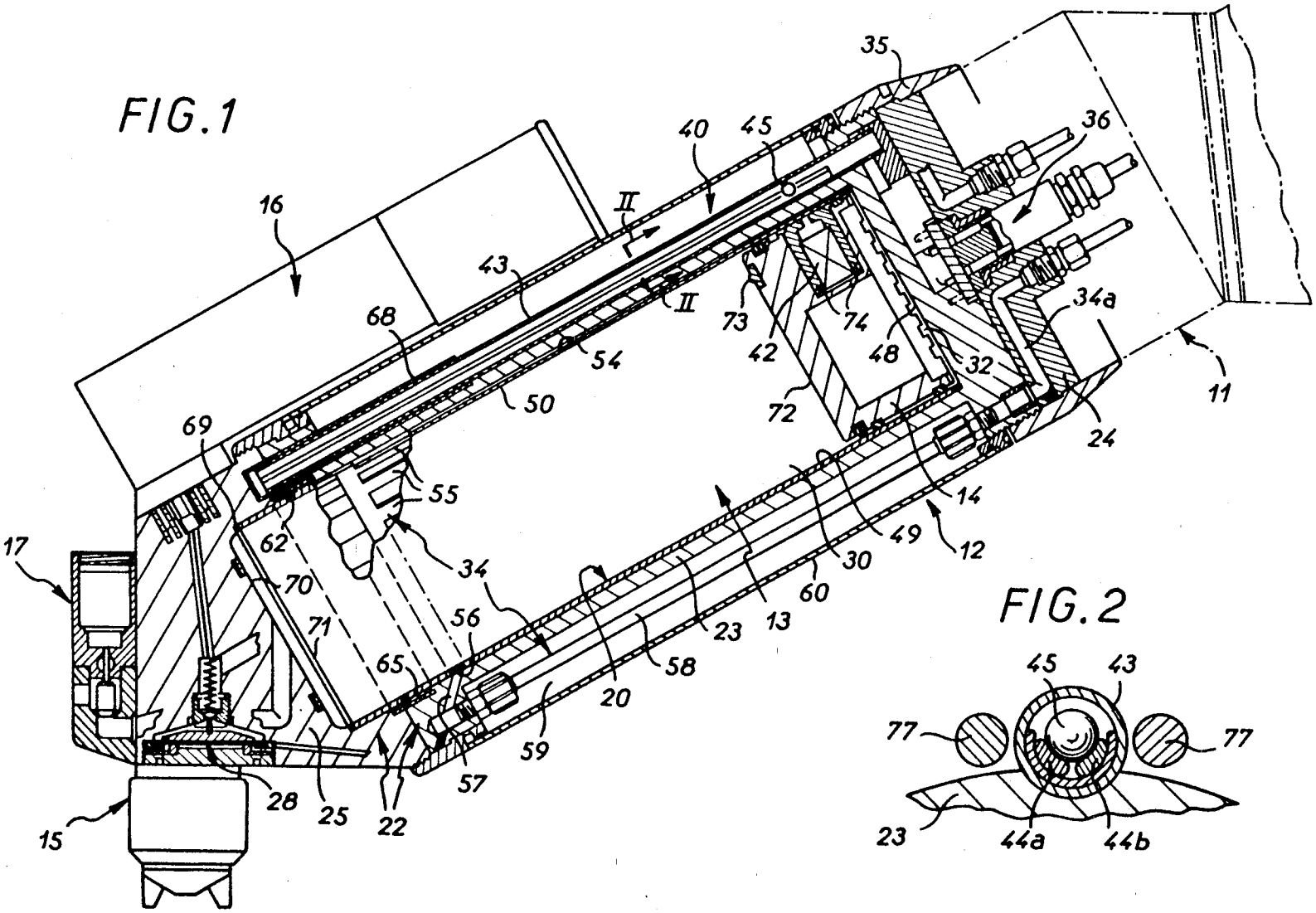
FIG. 1 is a cut away partial view in longitudinal cross-section of the end part of an electrostatic sprayer device including an insulated intermediate storage tank and a coating product sprayer connected to the storage tank.
FIG. 2 is a detail view to a larger scale in cross-section on the line II—II in FIG. 1.

The electrostatic sprayer device as shown here comprises a known multi-axis robot 11 of which only the end part is shown in chain-dotted outline. To this end part is fixed cantilever-fashion a subassembly 12 comprising a storage tank 13 with a piston 14 inside it, an electrostatic sprayer 15 for the coating product connected to receive product from the storage tank, a high-voltage generator 16 and a connection unit 17 provided with connectors and pneumatic valves for connecting a cleaning and coating product supply installation (not shown). The structure of the connection unit is not part of the invention and will not be described in detail.

Suffice to say that the cleaning fluid and the coating product pass through this unit during cleaning and storage tank filling periods when the piston is at its extreme position nearest the sprayer so that said storage tank 13 has the minimum volume. The storage tank is defined within a generally cylindrical cavity 20 in an insulative material body 22 which is in two parts, comprising a first unit 23 in which the greater part of the storage tank is defined and which is fixed to a metal socket 24 carried by the end of the robot 11 and a second unit 25 carrying the electrostatic sprayer 15, its pneumatic flowrate regulator 28 and the previously mentioned connection unit 17. The piston 14 in said cavity forms a mobile wall separating a coating product chamber 30 (communicating with the electrostatic sprayer and the connection unit) from an actuation chamber 32 filled with an electrically insulative actuation fluid, air in this example. An actuation fluid supply circuit 34 necessarily discharges into said actuation chamber. This circuit extends between said actuation chamber and the socket 24 because, in order not to impede movement of the robot and to enable quick changing of the subsystem 12, all the pneumatic supply circuits and the electrical cables connected to it pass through the socket so that the electrical and pneumatic connections are grouped together in a kind of bundle within the multi-axis robot. The subassembly 12 is engaged with the socket 24 and fixed by a threaded ring 35. This mounting establishes the continuity of the various pneumatic circuits and makes the low-voltage electrical connections, here via an axial connector 36. For obvious safety reasons the robot as a whole, up to and including the socket 24, is grounded.

In the example specifically described the body also houses another electrically screened component, i.e. a component having a metal jacket adapted to be grounded and therefore likely to favor tracking currents. It is a resistive sensor 40 forming a kind of linear potentiometer of known structure adapted to be actuated by a magnet 42 carried by the piston 14. It has a tubular metal jacket 43 which is electrically connected to the socket. Briefly, a resistive sensor of this kind comprises two rectilinear tracks of resistive material **44*a*, 44*b* disposed side by side while a cursor 45 or the like consisting of or comprising a member sensitive to a magnetic field is caused to move along the two tracks parallel to the piston. In this example said cursor 45 is made of metal and is held in contact with the two tracks by the magnetic attraction force exerted by the magnet 42**.

The resistive sensor 40 is naturally adapted to produce an electrical signal representing the position of the piston 14 within the storage tank. It could be replaced by any other contactless means of sensing the position of the piston in the cavity. Nevertheless, as will emerge later, the invention makes it possible to deal with the additional problem created by the presence of an electrically screened sensor, i.e. a sensor whose metal jacket is grounded.

The back wall 48 of the cavity which is not in contact with the coating product and at least the greater part of the cylindrical wall 49 of the cavity 20 are defined within the same unit 23. In other words, the surface of this part of the cavity is continuous, with no nesting or inter-assembly of parts, and constitutes a flat-bottomed blind hole, as it were. A section of the air supply circuit runs substantially parallel to the cavity in the direction away from the socket 24 starting at the back wall 48. In this way the distance between the back wall 48 and the metal socket 24 may be relatively short with the result that the subassembly 12 mounted cantilever-fashion at the end of the robot arm is as compact and as light as possible. A direct passage between the back of the cavity and the part **34*a* of the supply circuit 34 formed in the socket would considerably increase the length of the block 23** between the cavity and said base to provide a sufficient length of pipe to prevent the occurrence of tracking currents.

In the example specifically described the piston 14 slides in a tubular liner 50 of electrically insulative material (ceramic, glass or plastics material, for example) which is a close fit in the cavity 20 and the aforementioned section of the actuation fluid supply circuit 34 comprises at least one longitudinal passage 54 defined between the surface of the cavity and the outside surface of the liner. The tubular liner 50 has at least one longitudinal groove 55 on its outside surface running from the end of said liner adjacent the back wall of the cavity to a circular connecting groove 56 communicating with a bore 57 in said body which is part of said actuation fluid supply circuit. As shown here, the tubular liner 50 preferably comprises a plurality of longitudinal grooves 55 equi-angularly distributed over its outside surface and all communicating with said circular connecting groove 56. The liner is pierced radially or crenellated at the end of each longitudinal groove to establish communication between said grooves and the actuation chamber 48. The respective edge of the skirt of the piston 14 is also crenellated, for the same reason. On the upstream side of the bore 57 the actuation fluid supply circuit comprises a rectilinear pipe 58 installed longitudinally in an exterior cylindrical recess 59 running along virtually all the length of the unit 23 to reduce the weight of the subsystem 12 mounted cantilever-fashion on the robot. This pipe is connected by screw connectors to the bore 57 and to the part **34*a* of the circuit in the socket. The circuit 34 is itself connected to a compressed air supply (not shown). The other air circuits supply the sprayer 15 and the regulator 28, for example, and are arranged in the same manner, i.e. they pass through the socket 24 and are extended by a pipe installed in the recess 59. This is covered with an insulative material cylindrical protective sleeve 60**.

A seal 62 is inserted between the two insulative material units 23, 25 constituting the body 22, outside the liner 50. This prevents actuation air injected into the circular groove 56 escaping in the plane at which the two units fit together.

Even if the back wall 48 of the cavity is at the high voltage, in particular when the piston 14 is in the position shown, the actuation air supply circuit 34 includes a section of sufficient length (at least between said back wall 48 and the circular groove 56) that no tracking current can be established towards any metal member at ground potential. In the example described, given the dimensions of the storage tank, the length of this section is in the order of 20 cm. For greater safety an insulative material tubular guard ring 65 is inserted into the two units 23, 25 perpendicular to the surface at which they fit together and coaxially with the cavity 20. This is a conventional means of combating tracking currents. The guard ring 65 is installed between the cavity 20, outside the liner 50, and the resistive sensor 40. Because the latter has a grounded metal jacket 43, said jacket is surrounded by an insulative material cover 68 over at least part of its length, at least near the end of said section of the actuation air supply circuit opposite the back wall 48 of the cavity, i.e. near the circular groove 56 and the plane at which the two units meet. In this example this cover is about 10 cm long and further reduces the risk of any tracking current flowing between the actuation air supply circuit and said resistive sensor.

The unit 25 enclosing the cavity also includes a cylindrical bore extending said cavity in which the tubular liner 50 is engaged. This cylindrical bore ends at a shoulder 69 whose width matches the thickness of the liner. This shoulder is very close to the end wall 70 of the cavity defined in the unit 25 at which the passages connected to the sprayer and to the connection unit 17 end. A seal 71 is inserted between the end of said liner and the shoulder. Its size is such that a substantially continuous surface is defined in the coating product chamber. To prevent any accumulation of coating product near the end of the liner at any time during the service life of the device it is made from a material which is not subject to any creep.

The side 72 of the piston 14 facing the end wall 70 has projecting insets 73 to prevent the walls sticking together at the end of travel.

As previously mentioned the piston 14 carries a magnet 42 in contact with two polepieces 74 which slide along the inside surface of the liner 20. This magnetic assembly entrains the cursor 45 of the resistive sensor. A magnet (in this example the same magnet 42) is coupled magnetically (by the same polepieces) to magnetic material (soft iron, for example) longitudinal guide means for stabilizing the piston against rotation. The guide means comprise two soft iron rods 77 disposed on either side of the resistive sensor over at least all of the path of the piston. This is a simple way to prevent any mechanical binding of the piston causing friction and leaks. The piston being prevented from rotating in this way, there is no doubt as to the quality of magnetic coupling between the cursor 45 and the magnet 42 and the exact position of the piston in the cavity is always known and the required variations in flowrate can be controlled accurately.

Figure 3:
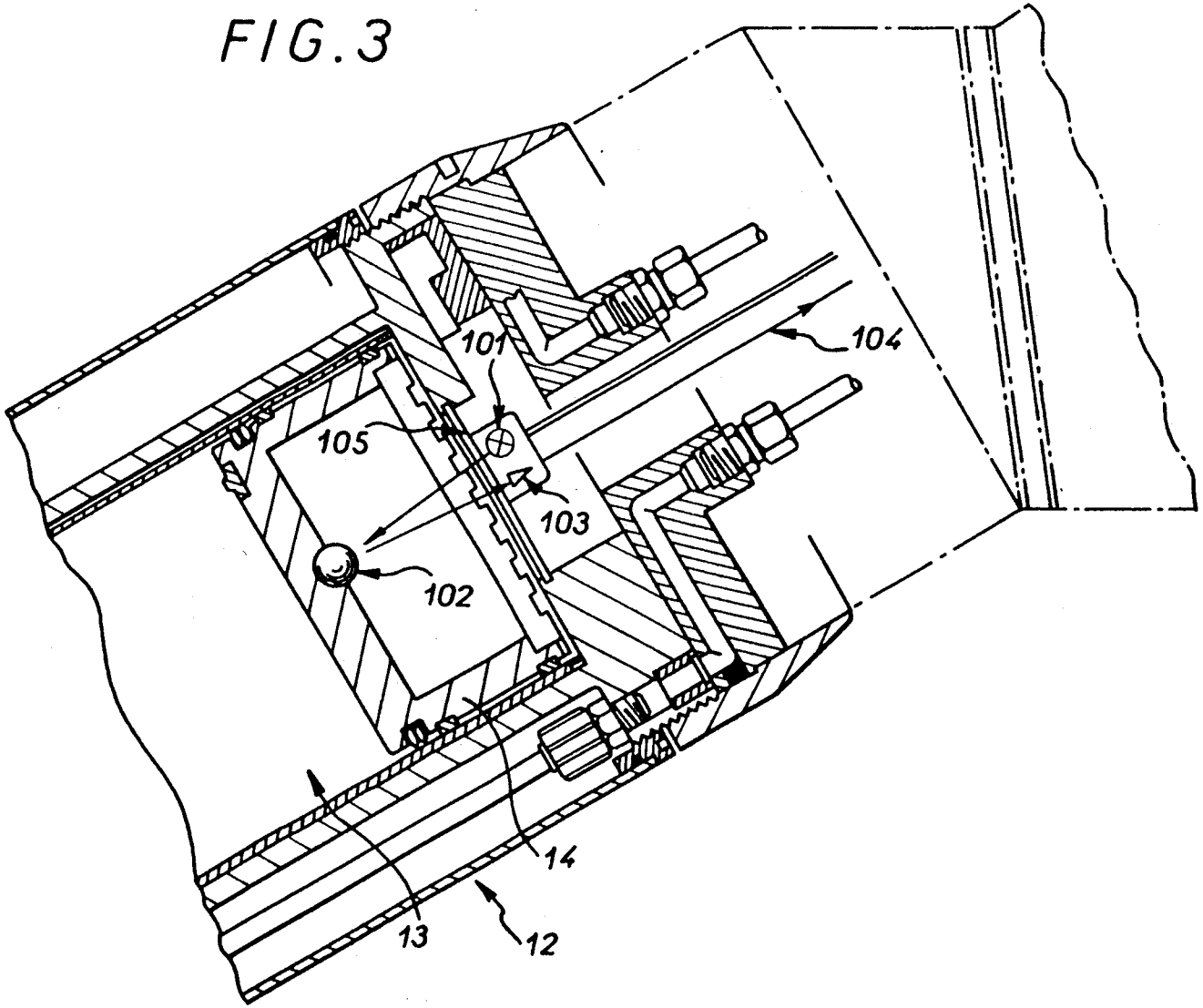
FIG. 3 is a partial view in cross-section and to a larger scale of the electrostatic sprayer device showing one embodiment of the device for measuring displacement of the piston.

In an embodiment of the invention shown in FIG. 3 in which structural members similar to those of FIG. 2 carry the same reference numbers as in the latter figure the piston displacement sensor is an optical sensor. A monochromatic light source 101 such as a laser diode emits a light beam A towards a reflective ball 102 fixed to the back of the piston 14. The reflected light signal B is captured by a Michaelson interferometer 103 and transmitted by an electrical conductor 104 to a central control unit (not shown). The signal obtained is representative of the displacement speed of the piston and therefore of the instantaneous flowrate of the coating product. It is not necessary to derive a position signal to determine this speed and therefore this flowrate. An insulative and transparent (for example glass) plate 105 set into the back of the storage tank insulates the interior of the storage tank 13 from the light source 101 and the sensor 103. There is no physical contact between the measuring device and the interior of the storage tank 13 and so tracking of the high voltage is prevented. This system is particularly advantageous as it does not require any calibration of the measuring device if the storage tank 13 is demounted. Its accuracy is in the order of 10 microns and is independent of operating conditions such as the ambient air quality and the cleanliness of the surface of the ball 102. Furthermore, provision may be made for the measuring device to remain in place if the subassembly 12 is replaced.

These measuring means may equally well be replaced by a Hall effect sensor.

There is claimed:

1. Electrostatic device for spraying electrically conductive liquid coating p comprising a storage tank flow the product in which the product is at a high voltage defined in a substantially cylindrical cavity formed in an insulative material body and inside which is a piston forming in said cavity a mobile wall separating a coating product chamber from an actuation chamber filled with an electrically insulative actuation fluid, said body being fixed to a conductive material socket which is grounded and to which is connected an actuation fluid supply circuit extending between said socket and said actuation chamber and discharging into said actuation chamber near a back wall of said cavity which is not in contact with the coating product, a section of said supply circuit running substantially parallel to said cavity in the direction away from said socket starting from said back wall.

2. Device according to claim 1 wherein said back wall and at least the greater part of the cylindrical wall of said cavity are defined in a common unit of said body.

3. Device according to claim 1 wherein said piston slides in an electrically insulative material tubular liner which is a close fit in said cavity and said section of actuation fluid supply circuit comprises at least one longitudinal passage defined between the inside surface of said cavity and the outside surface of said liner.

4. Device according to claim 3 wherein said tubular liner has at least one longitudinal groove on its outside surface extending from an end adjacent said back wall of said cavity to a circular connecting groove communicating with a bore in said body forming part of said actuation fluid supply circuit.

5. Device according to claim 3 wherein said unit of said body comprising the greater part of said cavity is assembled to a second unit closing said cavity, said tubular liner is engaged in a cylindrical bore of said second unit, said bore ending at a shoulder whose width matches the thickness of said liner and a seal is disposed between the end of said liner and said shoulder, the dimensions of said seal being such that a substantially continuous surface is defined in said coating product chamber.

6. Device according to claim 1 further comprising means for sensing the position of said piston in said cavity without mechanical contact therewith.

7. Device according to claim 6 wherein said sensing means comprises a linear potentiometer resistive sensor having cursor means comprising a member responsive to a magnetic field adapted to move parallel to said piston and said piston carries a magnet magnetically coupled to said cursor to displace it.

8. Device according to claim 7 wherein said resistive sensor has a grounded metal jacket with an insulative material covering extending over at least part of its length, at least from the vicinity of the end of the section of said actuation air supply circuit opposite said back wall of said cavity.

9. Device according to claim 7 wherein a magnet of said piston is coupled magnetically to longitudinal guide means disposed on either side of said resistive sensor to stabilize said piston against rotation over substantially all the length of the travel of said piston.

10. Device according to claim 9 wherein said longitudinal guide means comprises two magnetic material rods.

11. Device according to claim 6 wherein said sensing means are optical sensing means.

12. Device according to claim 6 wherein said sensing means comprise a light source and an interferometer and said piston carries a reflective surface on the side towards said light source.

* * * * *